0-531 SR
10/15/85 XP 4,546,608

United States Patent [19]
Shiina et al.

[11] Patent Number: 4,546,608
[45] Date of Patent: Oct. 15, 1985

[54] THERMO-SIPHON TYPE GENERATOR APPARATUS

[75] Inventors: Koji Shiina; Seiichiro Sakaguchi; Yasuaki Akatsu, all of Hitachi, Japan

[73] Assignee: Hitachi, Ltd., Tokyo, Japan

[21] Appl. No.: 536,518

[22] Filed: Sep. 28, 1983

[30] Foreign Application Priority Data

Sep. 29, 1982 [JP] Japan ..... 57-168647
Dec. 20, 1982 [JP] Japan ..... 57-221866

[51] Int. Cl.[4] ..... F01K 9/00; F01K 21/00
[52] U.S. Cl. ..... 60/649; 60/669; 60/531
[58] Field of Search ..... 60/649, 673, 669, 674, 60/531

[56] References Cited

U.S. PATENT DOCUMENTS 3,190,072 6/1965 Berryer ..... 60/671
3,908,382 9/1975 Stone, Jr. ..... 60/649
4,262,485 4/1981 Kuroda et al. ..... 60/649 X

*Primary Examiner*—Allen M. Ostrager
*Attorney, Agent, or Firm*—Antonelli, Terry & Wands

[57] ABSTRACT

A thermo-siphon type generator apparatus making use of a gravity-type heat pipe in which a working medium is cyclically evaporated and condensed. The apparatus has a closed vessel filled with the working fluid and defining a lower evaporating section, an upper condensing section and a heat-insulated section between the evaporating and condensing sections. A turbine connected to a generator is mounted in or on the closed vessel. A first passage is provided for introducing the vapor of the working fluid generated in the evaporating section to the turbine, while a second passage is adapted for introducing the vapor from the turbine to the condensing section. The evaporating section includes a reservoir chamber adapted to store the working fluid in liquid phase, and a vapor bubble pumping space communicated with the reservoir chamber and adapted to generate, when heated, upward movement of vapor bubbles of the working fluid thereby to forward the vapor of the working medium to the turbine through the first passage. A third passage is provided for returning the condensate liquid to the reservoir chamber.

11 Claims, 36 Drawing Figures

THERMO-SIPHON TYPE GENERATOR APPARATUS

BACKGROUND OF THE INVENTION

1. Field of the Invention:

The present invention relates to a thermo-siphon type generator incorporating a gravity-type heat pipe structure. More particularly, the invention is concerned with a thermo-siphon type generator in which a working medium confined in a vertically disposed closed vessel makes a repetitional evaporation and condensation and the vapor of this medium drives a turbine which is connected to a generator thereby to produce electric power.

2. Description of the Prior Art:

Generally, a power generating plant making use of waste heat is a large-scale plant having a complicated construction including a turbine connected to the generator, condenser, pump for recirculating the working medium, evaporator and piping for connecting these constituents. A thermo-siphon type generator making use of a gravity-type heat pipe as the power source for the turbine, is known as a simplified form of the power generating plant of the type described above. In the known thermo-siphon type generator, however, the power generating efficiency is often decreased due to a difficulty in maintaining a stable and good circulation of the working medium in the closed vessel.

SUMMARY OF THE INVENTION

Accordingly, an object of the invention is to provide a thermo-siphon type generator having a compact and simple construction and capable of maintaining stable and good circulation of the medium in the closed vessel thereby to ensure a high power-generating efficiency.

To this end, according to the invention, there is provided a thermo-siphon type generator apparatus comprising: a closed vessel filled with a working medium and defining a lower evaporating section, an upper condensing section and a heat-insulted section between the evaporating and condensing sections; a turbine connected to a generator; a first passage means for introducing the vapor of the working medium generated in the evaporating section of the turbine; a second passage means for introducing the vapor from the turbine to the condensing section; the evaporating section including a reservoir chamber adapted to store the working medium in liquid phase, and a vapor pumping space communicated with the reservoir chamber and adapted to generate, when heated, upward movement of vapor formed by the evaporation of the working medium thereby to forward the vapor of the working medium to the turbine through the first passage means; and a third passage means for returning the condensate liquid to the reservoir chamber.

The above and other objects, features and advantages of the invention will become clear from the following description of the preferred embodiment taken in conjunction with the accompanying drawings.

Throughout the drawings, like numerals are used to denote the same or equivalent parts or members.

DESCRIPTION OF THE PREFERRED EMBODIMENTS

Figure 1:
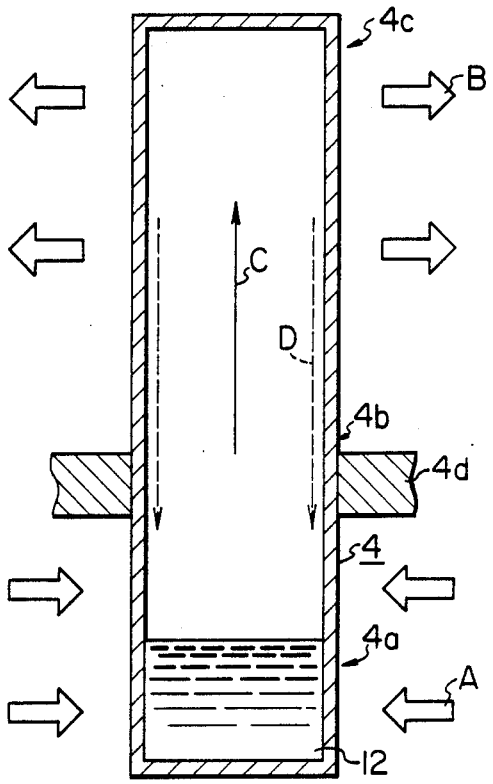
FIG. 1 PRIOR ART
FIG. 1 is a vertical sectional view of a known gravity-type heat pipe.

FIG. 1 shows a known gravity-type heat pipe. This heat pipe has a lower evaporating section 4*a* and an upper condensing section 4*c*. The vapor of a working medium generated in the evaporating section 4*a* as a result of heating is condensed in the condensing section 4*c* and the condensate is returned to the evaporating section 4*a* by the force of gravity, so that the working medium is circulated naturally.

To explain in more detail, as shown in FIG. 1, the evaporating section 4*a* is defined by a partition wall 4*d* at the lower portion of a closed pipe 4. The condensing section 4*c* is formed in the upper portion of the closed pipe 4. The intermediate portion of the closed pipe 4 between the upper condensing section and the lower evaporating section constitutes a heat-insulated section 4*b*. The closed pipe 4 is charged, after an evacuation, with the working medium 12 in the liquid state. As the evaporating section 4*a* is heated by the heat applied externally as indicated by arrows A, the working medium 12 in the liquid state is boiled to generate vapor which ascends as indicated by an arrow C into the condensing section 4*c* where the vapor is condensed into liquid phase by delivering heat to the outside as indicated by arrows B. The condensate is then returned to the evaporating section 4*a* by the force of gravity.

By the cyclic recirculation of the working medium 12 in the described manner, it is possible to effectively convey a large amount of heat continuously to a different place. In order to promote the recirculation of the working medium, it has been proposed to attach a wick to the inner surface of the closed pipe 1, the wick being formed of, for example, a metal having a high porosity, e.g. a metallic member containing a suitable material which enhances the wick action. This measure, however, is not so effective when applied to the gravity-type heat pipe described heretofore.

Hitherto, therefore, the apparatus of the kind described has been used mainly as a heat-collecting heat exchanger for use in combination with various industrial equipments to shift the heat through the air by making use of the working medium 12. It is, however, difficult to suitably use the generated vapor as the power for driving the generator turbine. Usually, the heat wasted from factories is used as the external heat source for heating the evaporating section 4*a* so that the flow of the vapor tends to become unstable due to a change in the temperature of the medium carrying the heat wasted from the factories.

Figure 2:
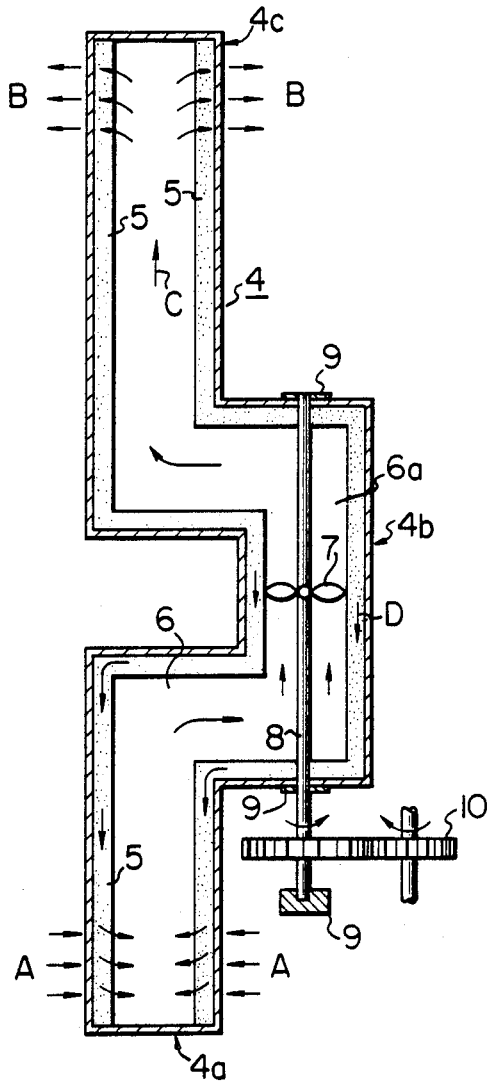
FIG. 2 PRIOR ART
FIG. 2 is a vertical sectional view of a known thermo-siphon type generator incorporating a gravity-type heat pipe.

FIG. 2 shows an example of a conventional thermo-siphon type generator apparatus having a gravity-type heat pipe. This apparatus has a turbine 7 disposed in the passage of flow of the working medium in the heat pipe vessel 4 so as to take out the energy possessed by the working medium. Thus, the heat pipe in this embodiment operates a kind of a heat engine.

As shown in FIG. 2, the closed vessel 4 has a lower evaporating section 4*a*, an intermediate heat-insulated section 4*b* and an upper condensing section 4*c*. The above-mentioned wick 5 is adhered to the inner surface of the closed vessel 4. The heat-insulated section 4*b* is formed at an offset from the evaporating section 4*a* and the condensing section 4*b* in order to permit the turbine 7 to be mounted therein. The turbine 7 is installed in the intermediate portion 6*a* of a heat-insulated passage 6 and is born by a rotary shaft 8 which is carried by the wall of the heat-insulated section through a bearing 9. The rotary shaft 8 is connected through a transmission 10 to the rotor shaft of a generator which is not shown. The vessel 4 accommodates a working medium which makes a phase change from liquid to vapor and vice versa.

As the evaporating section 4*a* is heated by the heat as indicated by arrows A, the working medium in the wick 5 is evaporated to become vapor which flows upward through the heat-insulated passage 6 to drive the turbine 7 as it flows across the turbine 7 disposed in the intermediate portion 6*a* of the heat-insulated section. Subsequently, the vapor flows upwardly as indicated by arrow C into the condensing section 4*c* where it is condensed into liquid phase by radiating heat as indicated by arrows B. The condensate is then returned as indicated by arrow D into the evaporating section. This heat pipe, therefore, can serve as a heat engine.

In the conventional thermo-siphon type generator apparatus shown in FIG. 2, it is quite difficult to obtain an adequate circulating flow of the medium indicated by arrows C and D, i.e. moderate upward flow of vapor as shown by arrow C and moderate downward flow of the condensate along the wick 5 as indicated by arow D, so that the power generating efficiency is impractically low. In addition, due to difficulty in maintaining a constant rate of heating by the external heat, the flow of low-boiling-point medium such as freon ammonia and the like used as the working medium is often made unstable. In order to eliminate this unstable flow, it is necessary to increase the heat capacity of the heat pipe to enhance the stability of the same against load fluctuation. This requires an increase of the heat transfer area and the size of the heat-insulated section to impractically increase the size of the heat pipe as a whole. In addition, since the heat-insulated section 4*b* is offset as stated before, it is not possible to use a simple straight pipe as the material of the heat pipe.

These problems or drawbacks of the invention, however, are overcome by the invention as will be understood from the following description.

Figure 3A:
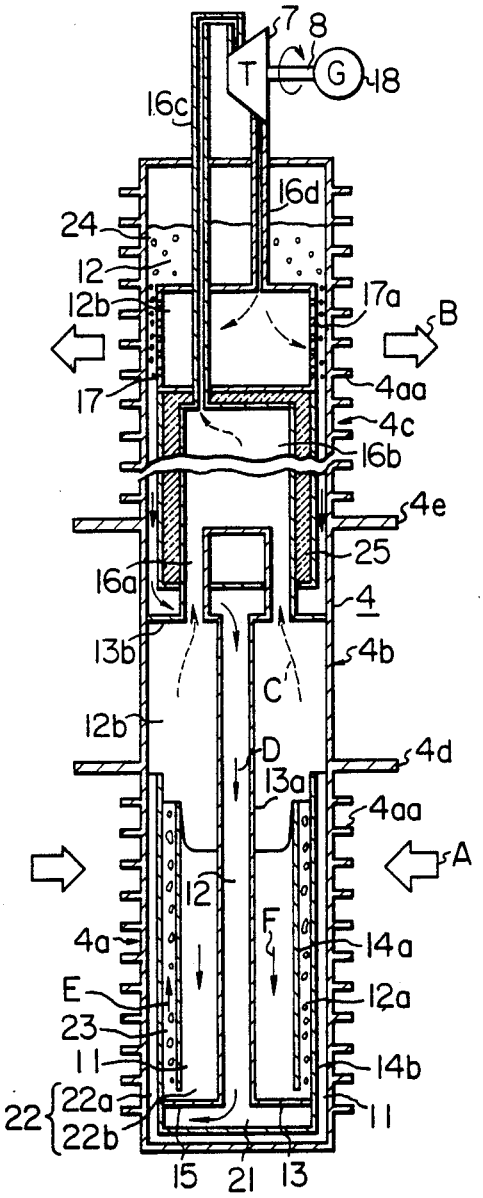
FIG. 3A is a vertical sectional view of a first embodiment of a thermo-siphon type generator in accordance with the invention.

Referring first to FIG. 3A showing a first embodiment of the invention, the evaporating section 4*a* has a first reservoir section 22 and a second reservoir section 21 which are adapted to store a heat medium liquid 11 and a low-boiling-point medium liquid 12 which are insoluble to each other. The evaporating section 4*a* further has a limited space or pumping space 23 for causing a vapor pumping action. The first reservoir section or chamber 22 and the second reservoir section or chamber 21 are separated from each other by a partition plate 13. A down-comer pipe 13*a* for low-boiling-point medium is connected to the second reservoir chamber 21 to extend upward therefrom. The limited space or pumping space 23 is formed between a partition outer pipe 14*b* suitably spaced from the inner surface of the closed vessel 4 and an inner partition pipe 14*a* disposed in the outer partition pipe 14*b* at a suitable distance from the latter. The arrangement is such that the low-boiling-point medium liquid 12 in the second reservoir chamber 21 is injected into the heat medium liquid 11 stored in the limited space 23. A pumping action is caused as the voids or gas bubbles from evaporation of the low-boiling-point medium are generated in the limited space 23, so that the two-phase medium including the heat-medium liquid 11 and the vapor of the low-boiling-point medium is sent to the upper side of the limited space 23, and a gas-liquid separation is made in the upper portion of the limited space 23 to separate the vapor of the low-boiling-point medium and the heat medium liquid 11 from each other. The thus separated vapor 12b of the low-boiling-point medium 12b is introduced into the space in the heat-insulated section 4b. The condensing section 4c has a third reservoir chamber 24 in which the vapor of the low-boiling-point medium discharged from the turbine 7 is condensed and stored. Although not clear from the drawings, the reservoir chamber 24 is communicated with a down-comer pipe 13a for the low-boiling-point medium. The pipe 13a leads to the second reservoir chamber 21. The evaporating section 4a, heat-insulating section 4b and the condensing section 4c are provided in a hollow cylindrical closed vessel 4 having no curve or bend. The vapor 12b of the low-boiling-point medium is introduced into an introduction passage 16c which provides communication between the heat-insulated section 4b and the turbine 7, thereby to drive the turbine 7.

The low-boiling-point medium 12 in the third reservoir chamber 24 is returned again to the second reservoir chamber 21. The heat medium liquid 11 taken out of the two-phase medium mentioned above is returned to the portion 22b of the first reservoir chamber 22 inside the limited space 23. According to this arrangement, when the heat medium liquid 11 and the low-boiling-point medium liquid 12 are heated to allow the injection of the low-boiling-point medium liquid into the limited space 23, gas vapor 12a caused by evaporation of the low-boiling-point medium is generated in the space 23 as stated before. Consequently, the natural recycling flow is caused to repeat evaporation and condensation to continuously drive the generator 18. The first embodiment of the invention described hereinabove will now be explained in more detail. The lower portion, mid portion and the upper portion of the space defined by the closed vessel 4 constitute, respectively, an evaporating section 4a, heat-insulated portion 4b and a condensing section 4c, respectively. The turbine 7 is disposed at the outside of the upper portion of the closed vessel 4. The generator 18 is connected to this turbine 7 through a rotor shaft 8. The evaporating section 4a includes a first reservoir chamber 22 for storing the heat medium liquid 11, a second reservoir chamber 21 for storing the low-boiling-point medium liquid 12 and a limited space 23 for causing a gas vapor pumping action. More specifically, the first reservoir chamber 22 is defined by the lower part of the space in the closed vessel 4. In this space are disposed an outer partition pipe 14b spaced by a suitable distance from the inner peripheral surface of the closed vessel 4 and an inner partition pipe 14a inside of the outer partition pipe 14b at a suitable distance from the latter. The space defined between the outer partition pipe 14b and the inner partition pipe 14a constitutes a limited, pumping space 23. The second reservoir chamber 21 is formed in a box-shaped wall which is disposed at a suitable distance from the bottom surface of the closed vessel 4. The lower end portion of the above-mentioned limited space 23, defined by the outer and inner partition pipes 14b and 14a is positioned in the vicinity of a partition plate 13 which constitutes a part of the box-like wall mentioned above. The partition plate 13 is provided with a low-boiling-point medium injector 15 for injecting the low-boiling-point medium liquid 12 from the second reservoir chamber 21 into the limited space 23. A down-comer pipe 13a for low-boiling-point medium, disposed substantially at a radially inner portion of the closed vessel 4 and extending upwardly, is connected to the second reservoir chamber 21. The limited space 23 stores the heat medium liquid 11. The arrangement is such that the vapor 12a of the low-boiling-point medium is formed as the low-boiling-point medium liquid is jetted into this limited space from the low-boiling-point medium liquid injector 15. Namely, the closed vessel 4 is heated by heat applied externally as indicated by arrows A to heat the heat medium liquid 11 into which the low-boiling-point medium liquid 12 which is also heated is injected to generate vapor 12a of the low-boiling-point medium. The bubbles or pockets of vapor 12a, which naturally move upwardly, cause a pumping action to produce an upward flow of the two-phase liquid gas mixture consisting of the heat medium liquid 12 and the low-boiling-point temperature medium vapor 12b in the limited space 23.

The heat medium liquid 11 stirred in the portion 22a of the second reservoir chamber adjacent to the inner peripheral surface of the closed vessel 4, i.e. in the space between the gap formed between the outer partition pipe 14b and the inner peripheral surface of the closed vessel 4 and the gap between the bottom of the second reservoir chamber 21 and the bottom surface of the closed vessel 4, serves to prevent any fluctuation in the externally applied heat from being directly transmitted to the limited space 23 and the second reservoir chamber 21, thereby to stabilize the flow of the heat medium liquid 11 and the low-boiling-point medium liquid 12.

The heat-insulated section 14b includes a space which is insulated from the external heat. The vapor 12b of the low-boiling-point medium generated as a gas-liquid separation of the two-phase medium is made to pass through this space. The vapor 12b of the low-boiling-point medium after an adiabatic expansion through the turbine 7 disposed at the upper outside of the closed vessel is sent through a turbine outlet pipe 16d extending through the closed vessel 4 and is stored in a low-pressure chamber 17 which is provided in the condensing section 4c. The third reservoir chamber 24 storing the low-boiling-point medium liquid 12 is formed to surround this low-pressure chamber 17. The low-pressure chamber 17 is provided with a low-boiling-point medium vapor injector 17a adapted to inject the vapor 12b of low-boiling-point medium into the low-boiling-point medium liquid 12 in the third reservoir chamber 24.

In the embodiment shown in FIG. 3A, the injector 17a is composed of a multiplicity of injection holes formed in the wall which surrounds the low-pressure chamber 17. Therefore, the vapor 12b of the low-boiling-point medium is partly condensed in the turbine outlet pipe 16d and partly by the direct contact with the low-boiling-point medium liquid 12. A partition plate 13b is provided at the lower end portion of the third reservoir chamber 24 adjacent to the heat-insulated section 4b so as to close the lower side of the third reservoir chamber 24. Although not shown in the drawings, means are provided for establishing a communication between the third reservoir chamber 24 and the down-comer pipe 13a for the low-boiling point medium.

A high-pressure chamber 16b for the vapor of the low-boiling-point medium is disposed, through the medium of a heat insulator 25, at a portion of the space in the third reservoir chamber 24 adjacent to the lower side of the low-pressure chamber 17 mentioned before. The chamber 16b and the heat-insulated section 4b are communicated with each other through an ascending passage 16a for the vapor of the low-boiling-point medium. The vapor 12b of the low-melting-point medium in the high-pressure chamber 16b is introduced through an introduction passage into the turbine 7. The introduction passage 16c is extended through the low-pressure chamber 17 and the third reservoir chamber 24.

The evaporating section 4a, heat-insulated section 4b and the condensing section 4c constructed as described hereinbefore are disposed in the closed vessel 4 which has no bend. Fins 4aa are provided on the portions of the wall of the closed vessel 4 around the evaporating section 4a and the condensing section 4b. The turbine 7 is detachably fixed to the upper side of the closed vessel 4 externally of the latter. The outer peripheral wall of the closed vessel 4 is provided at its portions between the evaporating section 4a and the heat-insulated section 4b and between the condensing section 4c and the heat-insulated section 4b with an evaporating section mounting joint 4d and a condensing section mounting joint 4e, respectively, to facilitate the connection of these portions to the external ducts which are not shown.

The first embodiment having the described construction operates in a manner explained hereinunder.

The evaporating section 4a is connected by means of the evaporating section mounting joint 4d to a duct (not shown) containing a medium or low-temperature heat source so as to project into the duct. As the heat is applied as indicated by arrows A, the heat is transmitted to the inside of the evaporating section 4a so as to heat the heat medium liquid 11 in the space between the wall of the closed vessel 4 and the outer partition pipe 14b, as well as the heat medium liquid 11 in the space between the bottom of the closed vessel 4 and the bottom of the second reservoir chamber 21. The heat medium liquid 11 in these spaces function as a buffer for absorbing any fluctuation in rate of delivery of the heat from the external heat source and also as a heat accumulator during the operation of the apparatus.

Then, the low-boiling-point medium liquid 12 in the second reservoir 21 is preheated and is injected into the limited space 23 through the low-boiling-point medium liquid injector 15. In consequence, vapor bubbles 12a of the low-boiling-point medium are generated in the limited space to move upwardly in the latter to cause a pumping action which produces an upward flow of the two-phase medium consisting of the heat medium liquid 11 and the vapor 12b of the low-boiling-temperature in the limited space as indicated by an arrow E. Then, a gas-liquid separation is made on the liquid surface in the limited space 23 to separate the heat medium liquid 11 and the vapor 12b of the low-boiling-point medium from each other. In consequence, the vapor 12b of the low-boiling-point medium is made to flow upwardly into the heat-insulated section 4b. On the other hand, the heat medium liquid 11 separated from the low-boiling-point medium 11 flows downwardly through the portion 22b of the reservoir chamber 22 defined between the down-comer pipe 13a for the low-boiling-point medium and the inner partition pipe 14a surrounding the down-comer pipe 13a as indicated by an arrow F so as to be stored in the portion 22b of the reservoir chamber 22. Even if a small amount of the unevaporated liquid component of the low-boiling-point medium happens to be contained by the descending flow of the heat medium liquid 11 due to an insufficient heating by the external heat, no substantial problem is caused because such unevaporated component is heated and recycled. Therefore, once the closed vessel is heated by the heat supplied externally, a natural recirculating flow by the void pumping action is caused and maintained semi-permanently in the evaporating section 4a.

On the other hand, the vapor 12b of the low-boiling-point medium is moved through the heat-insulated section 4b to ascend through the ascending passage 16a as indicated by arrows C and is temporarily stored in the high-pressure chamber 16b for the low-boiling-point medium vapor. The vapor 12b of the low-boiling-point medium is then introduced through the introduction passage 16c into the turbine 7. The vapor 12b then makes an adiabatic expansion to drive the turbine 7 which in turn drives the generator 18 through the rotor shaft 8. In the described embodiment, a radial inflow-type turbine is used as the turbine 7 because such type of turbine can operate at a higher efficiency than the axial-flow turbine. The vapor 12b of the low-boiling-point medium discharged from the turbine 7 through the turbine outlet pipe 16d is temporarily stored in the low-pressure chamber 17 for the low-boiling-point medium vapor and is then injected into the low-boiling-point medium liquid 12 in the third reservoir chamber 24 by means of the low-boiling-point medium vapor injector 17a. The vapor 12b is condensed through direct contact with the low-boiling-point medium liquid 12. More specifically, the vapor 12b of the low-boiling-point medium is condensed partly in the turbine outlet pipe 16d and partly through direct contact with the liquid-phase of the low-boiling-point medium, while delivering heat to the outside as indicated by arrows B, and is stored in the third reservoir chamber 24. Subsequently, the low-boiling-point medium in the third reservoir chamber 24 is made to flow downwardly through the down-comer pipe 13a as indicated by arrows D and is returned into the second reservoir chamber 21 in the evaporating section 4a. This operation is repeated cyclically to generate electric power continuously.

Figure 3B:
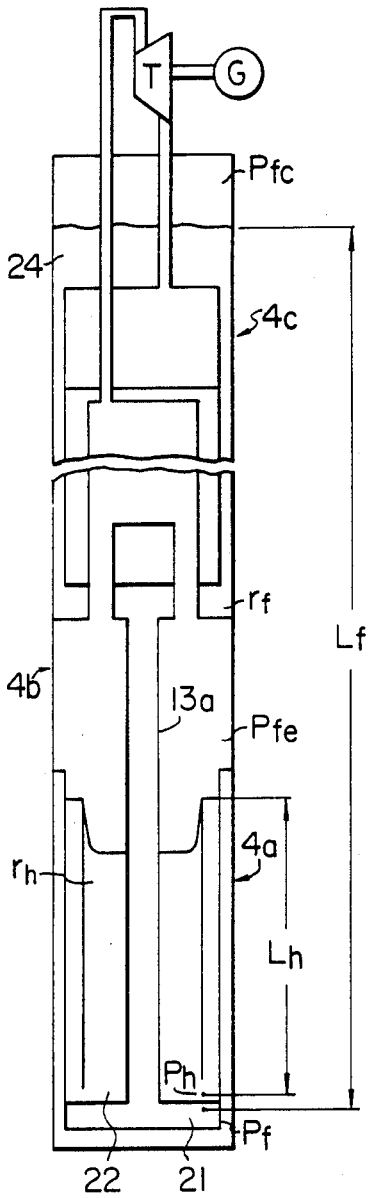
FIG. 3B is a diagrammatic illustration of the first embodiment for explaining the pressures of a working medium in the apparatus.

An explanation will be made hereinunder as to the pressures developed in every portions of the apparatus of this embodiment, with specific reference to FIG. 3B.

The pressure Pf of the low-boiling-point medium liquid 12 in the reservoir chamber 21 in the evaporating section 4a is the sum of the saturation pressure Pfc of the low-boiling-point medium acting on the liquid in the third reservoir chamber 24 in the condensing section 4c and the head rfLf constituted by the liquid column in the reservoir chamber 24, down-comer pipe 13a for the low-boiling-point medium and the reservoir chamber 21. Note that rf here means the specific weight of the low-boiling-point medium liquid 12, while Lf represents the difference of the height. On the other hand, the pressure Ph of the heat medium is equal to the sum of the saturation pressure Ph of the low-boiling-point medium in the heat-insulated section 4b and the head rhLh of the liquid in the first reservoir chamber 22. Note that rh here means the specific weight of the heat medium liquid 11 and Lh represents the difference of the head.

In order to inject the low-boiling-point medium liquid from the second reservoir chamber 21 into the first reservoir chamber 22 as explained before, it is necessary that the pressure Pf of the low-boiling-point medium and the pressure Ph of the heat medium are determined to meet the following condition:

$$Pf > Ph$$

As will be understood from the foregoing description, in the first embodiment of the thermosiphon type generator apparatus of the invention, all of the constituents except the turbine and the generator connected to the turbine are assembled in a compact manner within the closed pipe having no bend. Thus, the apparatus as a whole is made highly compact and simple. In addition, the working medium is circulated in a smooth manner in the closed vessel to repeat the evaporation and condensation cyclically, by the vapor pumping action without requiring any separate circulating pump. In consequence, the power generating efficiency is improved through decreasing the input power. In the described first embodiment, the thermosiphon type generator apparatus is composed of two parts: namely, the closed vessel 4 containing the heat-exchanging sections for causing the evaporation and condensation of the medium, and the power pick-up section including the turbine and the generator arranged externally of the closed vessel 4. It is, therefore, possible to construct the closed vessel 4 accomodating various constituents and the power pick-up section including the turbine 7 and the generator 18 in the form of separate units, so that the apparatus as a whole can be assembled simply at a low cost by connecting these units constructed separately.

Figure 4:
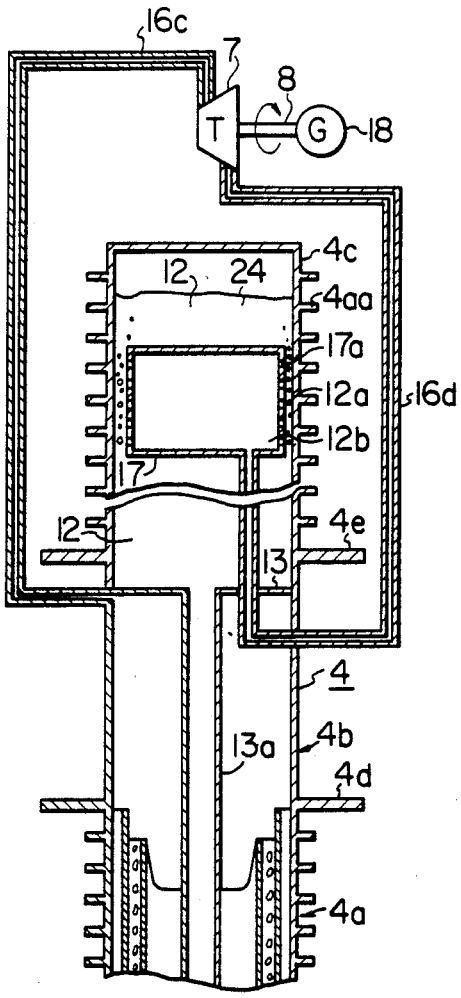
FIGS. 4 and 5 are vertical sectional views of a second embodiment and a third embodiment of the invention, respectively.

FIG. 4 shows a second embodiment of the invention in which the same reference numerals are used to denote the same parts or members as those in FIG. 3A.

In the first embodiment of the invention, both of the introduction passage 16*c* and the turbine outlet pipe 16*d* are extended to the turbine 7 through the reservoir chamber 24 in the condensing section 4*c*. In the second embodiment of the invention, these pipes are lead to the outside of the closed vessel 4 and connected to the turbine 7. Namely, the second embodiment is devoid of the high-pressure chamber 16*b* for the low-boiling-point medium vapor used in the first embodiment, and the introduction passage 16*c* connected between the heat-insulated section 4*b* and the turbine 7 is disposed at the outside of the closed vessel 4. The low-pressure chamber 17 for the low-boiling-point medium is connected to the turbine 7 through the turbine outlet pipe 16*d* which is also disposed at the outside of the closed vessel 4.

According to this arrangement, the undesirable condensation of the vapor 12*b* of the low-boiling point medium in the turbine introduction passage or pipe 16*c*, through indirect heat exchange with the low-boiling-point medium liquid 12 in the reservoir chamber 24, is suppressed to improve the condensation efficiency. In addition, the construction of the apparatus as a whole can be simplified thanks to the elimination of the high-pressure chamber 16*b* for the low-boiling-point medium vapor.

Figure 5:
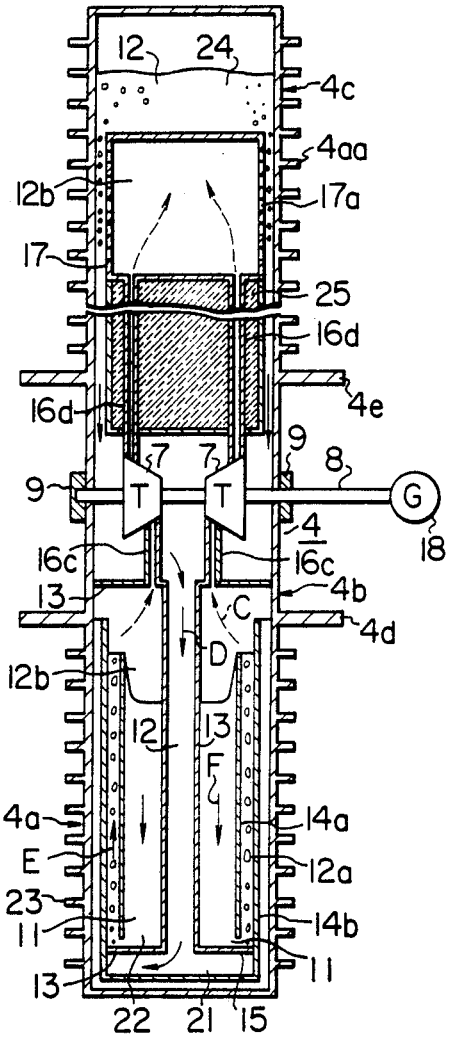

FIG. 5 shows a third embodiment of the invention. In this Figure, the same reference numerals are used to denote the same parts or members as those used in FIG. 3A. In this third embodiment, turbines 7 are disposed in the space within the heat-insulated section 4*b* of the closed vessel. These turbines have a common shaft which is supported by the wall of the closed vessel 4 through bearings 9. As in the case of the second embodiment, the third embodiment shown in this Figure is devoid of the high-pressure chamber 16*b* for the vapor of low-boiling-point medium, and the vapor 12*b* of the low-boiling-point medium is introduced from the heat-insulated section 4*b* into the turbines 7 through the introduction passages 16*c* which are disposed in the closed vessel 4. The vapor 12*b* of the low-boiling point medium disharged from the turbine 7 is introduced into the low-pressure chamber 17 for the low-boiling-point medium, through the turbine outlet pipes 16*d* which also are disposed in the closed vessel 4. The space around the turbine outlet pipes 16*d* is filled with a heat-insulating material 25. Thus, in the third embodiment of the invention, all of the turbine 7, introduction passages 16*c* and the turbine outlets 16*d* are disposed in the closed vessel 4 so that the construction of the apparatus is made more compact. This embodiment, however, encounters problems in connection with the difficulty in the mounting of the turbine 7 in the closed vessel 4 and due to the necesity for the provision of seals between the rotor shaft 8 of the turbine and the wall of the vessel 4.

Figure 6A:
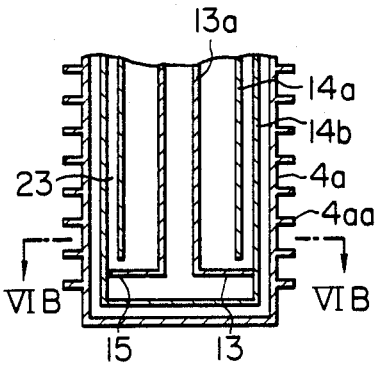
FIG. 6A is a vertical sectional view of an evaporator incorporated in the embodiments shown in FIGS. 2, 4 and 5.
Figure 6B:
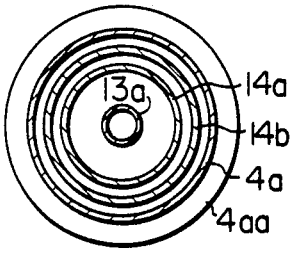
FIG. 6B is a cross-sectional view taken along the line VIB—VIB of FIG. 6A.

FIGS. 6A and 6B shows the detail of the evaporating section 4*a* in the embodiments described hereinbefore. As stated before, the evaporating section 4*a* accomodates an outer partition pipe 14*b* and the inner partition pipe 14*a*. The limited space 23 defined by these pipes accomodates the heat medium liquid 11. Vapor bubbles 12*a* of the low-boiling-point medium are formed as the low-boiling-point medium liquid 12 is injected into this heat medium liquid. In the embodiment shown in FIGS. 6A and 6B, the limited space 23 has a small radial width and extends substantially vertically over a predetermined length (see FIG. 6A) and has a continuous annular cross-secion as shown in FIG. 6B.

Figure 6C:
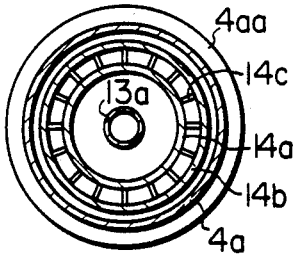
FIG. 6C and 6D are cross-sectional views similar to those in FIGS. 6A and 6B, showing a modification of the construction shown in FIGS. 6A and 6B.

FIG. 6C shows a modification in which the limited space 23 is sectioned circumferentially into plurality of sections by means of a pluality of partition plates 14*c* which extend vertically and radially in the limited space 23 so as to connect the inner and outer partition pipes 14*a* and 14*b*. This arrangement offers an advatage that the vapor bubbles 12*a* of the low-boiling-point can move upwardly in independent sections of the limited space without merging with one another. If the vapor bubbles 12*a* of the low-boiling-point medium merge with one another to form greater bubbles or pockets of vapor, the efficiency of heat exchange between the low-boiling-point medium liquid 12 and the heat medium liquid 11 is decreased and an unstable flow component is produced in the upward flow of the two-phase medium. It will be understood that the modification shown in FIG. 6C in which the limited space is divided into a plurality of sections is effective in suppressing such problems.

Figure 6D:
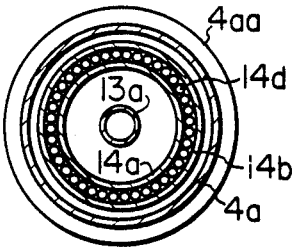

FIG. 6D shows another modification in which a multiplicty of partition tubes of small diameter are disposed in the limited space in a side-by-side fashion in the circumferential direction, and the voids of the low-boiling-point medium are generated in respective partition tubes 14*d*. It will be clear to those skilled in the art that this arrangement offers the same advantage as the arrangement explained in connection with FIG. 6C.

Figure 7:
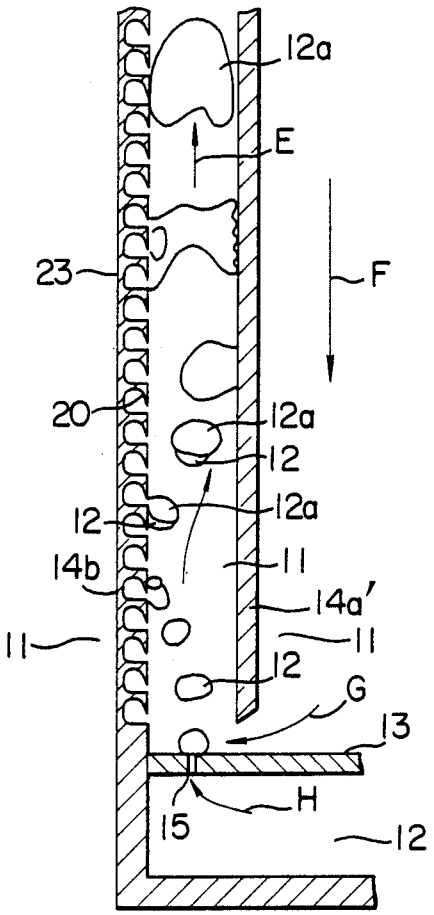
FIG. 7 is a partial enlarged sectional view of a void promotion mechanism adoptable in the first to third embodiment.

FIG. 7 shows an example of a mechanism for promoting the generation of gas bubbles in the limited space 23. In this example, the inner partition pipe 14*a*' which is one of the constituents of the limited space is made from a porous plate. On the other hand, a multiplicity of recesses 20 are formed and arrayed in circumferential and axial directions in the inner surface of the outer partition pipe 14*b* facing the limited space 23. Each recess 2 has a contracted entrance opening and an ample inward space. The low-boiling-point medium liquid 12 injected into the limited space from the low-boiling-point medium liquid injector 15 which will be explained later is trapped in the recesses 20 which form sites for initiating boiling a vaporization. In consequence, the voids or vapor bubbles 12*a* of the low-melting-point medium are generated and allowed to grow so that the generation of vapor bubbles is promoted. The same applies also to the porous plate 14*a*'. Consequently, the vapor bubbles of the low-boiling-point medium are made to move upwardly as indicated by arrow E, while increasing the size thereof. Although the recesses 20 are formed in the inner peripheral surface of the outer partition pipe 14*b* in the illustrated example, it is possible to form these recesses 20 in the outer peripheral surface of the inner partition pipe or to form the recesses in both of these pipes. It is also possible to form the outer partition pipe 14*b* from porous plate.

Various forms of the low-boiling-point medium injector 15, applicable to all embodiments described hereinbefore, will be explained hereinunder with reference to FIGS. 8A to 8E.

Figure 8A:
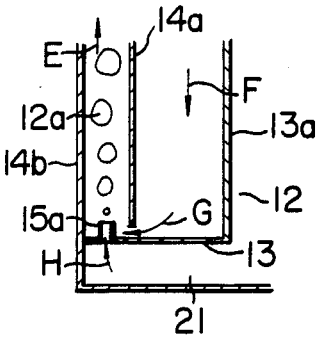
FIGS. 8A to 8E are vertical sectional views showing the detail of a low-boiling-point medium liquid injector adaptable in the first to third embodiments.
Figure 8B:
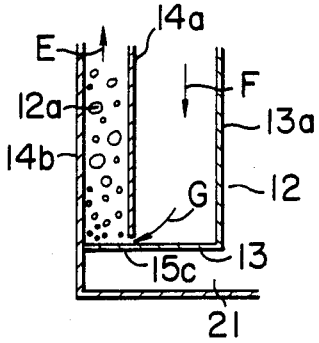
Figure 8C:
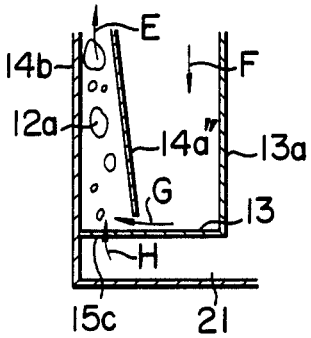
Figure 8D:
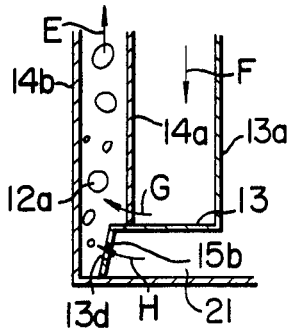

Referring first to FIG. 8A, the partition plate 13 defining the second reservoir chamber 21 is provided with a low-boiling-point medium liquid injection nozzle 15*a* which opens to the lower end of the limited space 23 defined between the inner partition pipe 14*a* and the outer partition pipe 14*b*. On the other hand, a gap is formed between the lower end of the inner partition pipe 14*a* and the partition plate 13 so as to allow the heat-medium liquid 11 to flow into the limited space as indicated by arrow G. The low-boiling-point medium liquid 12 in the second reservoir chamber 21 is injected into the limited space through the nozzle 15*a* as indicated by arrow H, hereby to generate voids 12*a* of the low-boiling-point medium. FIG. 8B shows an arrangement in which the partition plate 13 is formed of a porous plate 15*c* for injecting the low-boiling-point medium liquid. And a different arrangement shown in FIG. 8C, a tapered inner partition pipe 14*a*'' is provided to gradually decrease the size of the limited space towards the upper side, and the low-boiling-point medium liquid 12 is injected through the porous plate 15*c* for injecting low-boiling-point medium liquid. With this arrangement, it is possible to increase the velocity of the upward flow of the two-phase medium. In a further different arrangement shown in FIG. 8D, a partition wall 13*d* is provided to space the outer peripheral surface of the second reservoir chamber 21 away from the inner peripheral surface of the outer partition pipe 14*b* and injection ports 15*b* for injecting the low-boiling-point medium are formed in this partition wall 13*d*.

Figure 8E:
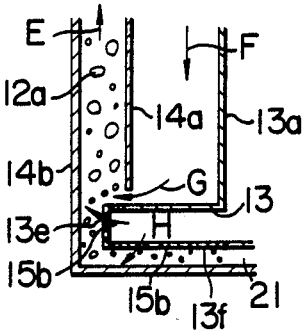

FIG. 8E shows a still different arrangement in which the outer peripheral surface of the second reservoir chamber 21 is spaced from the inner peripheral surface of the outer partition pipe 14*b* and, at the same time, partition walls 13*e* and 13*f* having the low-melting-point medium liquid injection ports 15*b* are disposed to space the bottom of the reservoir chamber 21 from the bottom of the outer partition pipe 14*b*. According to this arrangement, it is possible to obtain a longer time for preheating the low-boiling-point medium liquid 12 and to increase the injection area.

Figure 9:
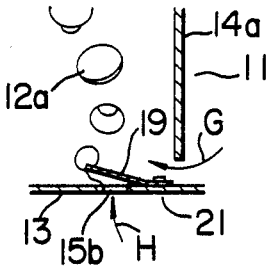
FIG. 9 is a partial sectional view showing a check valve mechanism which is used in connection with the low-boiling-point medium liquid injector.

In the first to third embodiments described hereinbefore, a gap is formed between the lower end of the inner partition pipe 14*a* and the upper surface of the second reservoir chamber 21, for allowing the heat medium liquid 11 to flow into the limited space 23. At the same time, a check valve mechanism 19 may be disposed in the vicinity of the gap as shown in FIG. 9. More specifically, the check valve 19 is disposed on the partition plate 13 between the second reservoir chamber 21 and the limited space 23, and is adapted to prevent the heat medium liquid in the limited space 23 from flowing back into the second reservoir chamber 21 through the injection port 15*b* as indicated by arrow G, while permitting the low-boiling medium 12 from flowing into the limited space 23 through the injection port 15*b*.

Figure 10A:
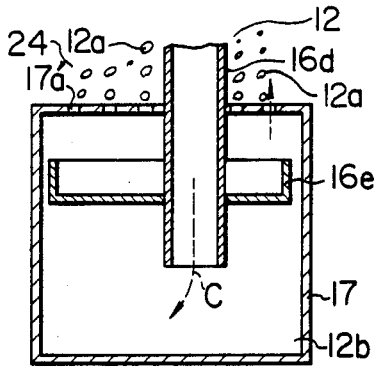
FIGS. 10A and 10B are vertical sectional views of a low-boiling-point medium vapor injector provided in the condensation section.
Figure 10B:
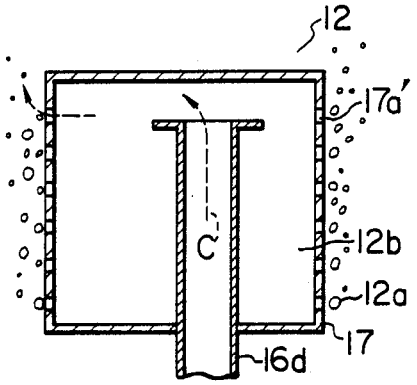

FIGS. 10A and 10B show examples of the low-boiling-point medium vapor injector 17*a*. More specifically, FIG. 10A shows an example which can be adopted in the embodiment shown in FIG. 3A. Referring to FIG. 10A, the low-pressure chamber 17 for the vapor of the low-boiling-point medium receives the turbine outlet pipe 16*d* leading from the upper side thereof. The turbine outlet pipe 16*d* is supported at a portion thereof near the insertion end by a receiving vessel 16*e* mounted in the low-pressure chamber 17 of the low-boiling-point medium. A plurality of low-boiling-point medium vapor injection ports 17*a*' are formed in the upper wall of the low-pressure chamber 17 for the low-boiling-point medium. The vapor 12*b* of the low-boiling-point medium in the low-pressure chamber is injected into the low-boiling-point medium liquid 12 in the reservoir chamber 24 through the injection ports 17*a*'. This arrangement affords the condensation of the vapor 12*b* through direct contact with the liquid phase 12 of the low-boiling-point medium. The receiving vessel 16*e* serves to receive the condensate in the reservoir chamber 24 dripping from the latter through the injection ports 17*a*'. When, for example, the operation of the apparatus is suspended for a while, the pressure in the reservoir chamber 24 may become higher than the pressure in the low-pressure chamber for the low-boiling-point medium chamber. The dripping of the condensate may occur in such a case.

FIG. 10B shows another example in which the turbine outlet pipe 16*d* is inserted into the low-pressure chamber 17 for the low-boiling-point medium vapor from the lower side of the same. This example, therefore, can be used in the embodiments shown in FIGS. 4 and 5. A multiplicity of injection holes 17*a*' for injecting the vapor of the low-boiling-point medium are formed in the peripheral wall of the low-pressure chamber 17. The outer peripheral surface of the low-pressure chamber 17 is positioned in the vicinity of the inner surface constituting the condensing section of the closed vessel 4, so that it is possible to bring the vapor 12*b* of the low-boiling-point medium into contact with the coldest portion of the low-boiling-point medium liquid 12, thereby to increase the condensation efficiency.

Figure 11:
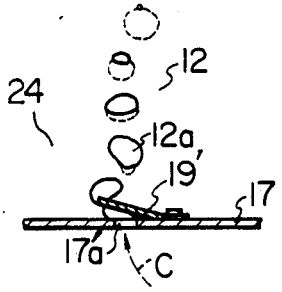
FIG. 11 is a partial sectional view showing a check valve mechanism provided in connection with the low-boiling-point medium vapor injector.

Each of the embodiments described heretofore may be provided with a check valve mechanism which acts to prevent the low-melting-point medium liquid 12 from flowing into the low-pressure chamber 17 for the vapor of the low-boiling-point medium. FIG. 11 shows an example of such a check valve mechanism 19'. More specifically, this check valve mechanism 19' is mounted on the wall of the low-pressure chamber 17 for the low-boiling-point medium vapor and is adapted to prevent the liquid phase 12 of the low-boiling-point medium from flowing from the reservoir chamber 24 back into the low-pressure chamber 17, while allowing the vapor 12*b* of the low-boiling-point medium to flow from the low-pressure chamber 17 into the reservoir chamber 24 through the injection holes 17*a*'.

Figure 12A:
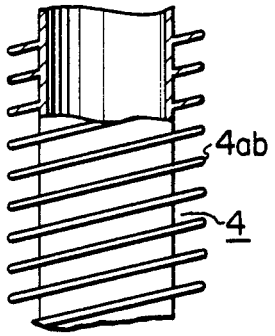
FIG. 12A and 12B are sectional views of a fin mechanism provided on the closed vessel.
Figure 12B:
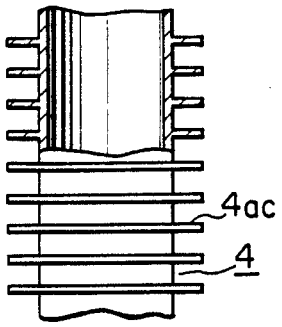

FIGS. 12A and 12B show examples of the construction of the portions of the outer peripheral wall of the closed vessel 4 around the evaporating section 4*a* and the condensing section 4*c*. These examples are applicable to any one of the first to third embodiments described hereinbefore. Usually, the fluid which is brought into contact with the outer peripheral wall of the closed vessel 4 is a contaminated fluid. For instance, warm water discharged from factories or geothermal water is used for heating the evaporating section 4*a*, while water for industrial use, for example, is employed for carrying the heat from the condensing section 4*c*. Therefore, if the outer peripheral surface of the closed vessel 4 is roughened for improving the heat-transfer efficiency, the surface of the closed vessel 4 becomes more liable to be contaminated by the contaminant resulting in a lower efficiency. To avoid this problem, it is advisable to employ a fin mechanism 4*aa* as shown in FIGS. 3A, 4 and 5 on the outer peripheral surface of the closed vessel 4. FIG. 12A shows a fin mechanism 4*aa* constituted by a high-fin tube 4*ab*, while FIG. 12B shows a fin mechanism constituted by disc fins 4*ac*. By suitably selecting the pitch of these fins, it is possible to eliminate any unfavourable effect of the contaminated fluid. In addition, it is possible to shorten the axial length of the closed vessel 4 by using fins having a sufficiently large heat transfer area.

Figure 13A:
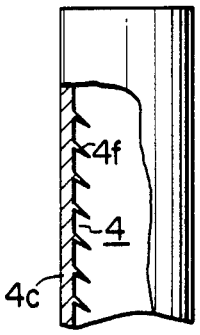
FIGS. 13A and 13B are vertical sectional views showing the structure of the inner peripheral surface of the condensation section of the closed vessel.
Figure 13B:
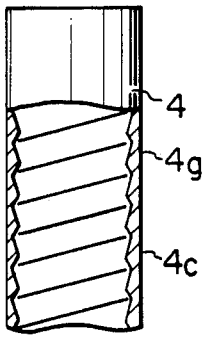

FIGS. 13A and 13B show examples of the construction of the inner peripheral surface of the condesign section in the closed vessel 4. These examples are applicable to any one of the first to third embodiments described hereinbefore. In the example shown in FIG. 13A, a multiplicity of fins 4*f* having keen edges are formed on the inner peripheral surface of the closed vessel 4 defining the condensing section 4*c*, at a suitable pitch in the axial direction. These fins 4*f* effectively increase the heat transfer coefficient to enhance the condensation in the condensing section. A similar effect is produced in another example shown in FIG. 13B in which the closed vessel 4 is composed of a pipe having grooves in the inner peripheral surface thereof.

Figure 14:
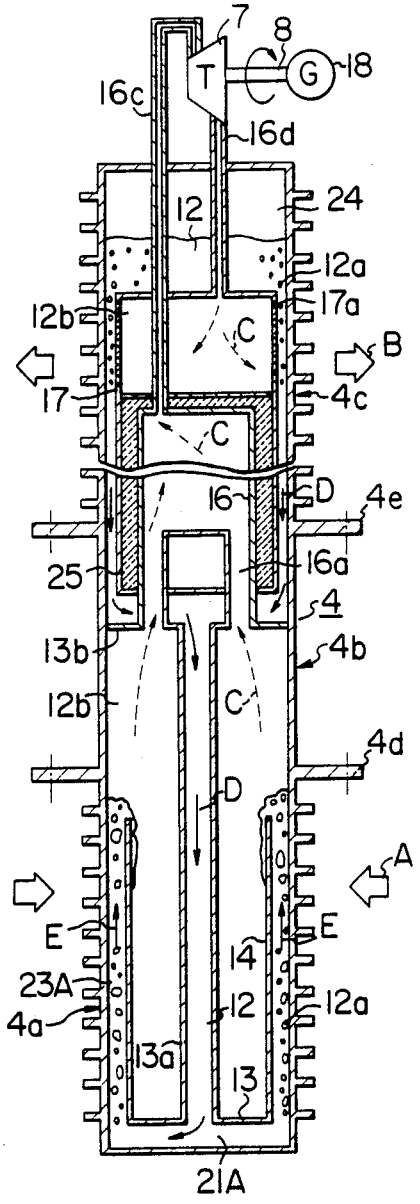
FIG. 14 is a vertical sectional view of a fourth embodiment of the thermo-siphon type generator in accordance with the invention.

FIG. 14 shows a fourth embodiment of the invention. This embodiment also has a closed vessel 4 charged with the working fluid and defining the evaporating section 4*a*, heat-insulated section 4*b* and the condensing section 4*c*. A power generating unit including the turbine 7 and the generator 18 connected to each other through the shaft 8 is mounted on the vessel 4. In order to separate the liquid phase and vapor phase of the working medium 12, vessel 4 is provided therein with a partition plate 13 and a down-comer pipe 13*a*. In addition, a two-phase flow partition pipe 14 is disposed in the evaporating section 4*a* in order to stabilize the circulation of the working medium 12. Furthermore, a high-pressure vessel 16 and a low-pressure vessel 17 for the vapor of the working medium are disposed in the condensing section 4*c*, in order to receive the vapor 12*b* of the working medium before entering the turbine 7 and after coming out of the turbine 7, respectively. In order to facilitate the connection to external ducts, an evaporating section mounting joint 4*d* and a condensing section mounting joint 4*e* are formed on the portions of the vessel 4 between the evaporating section 4*a* and the heat-insulated section 4*b* and between the condensing section 4*c* and the heat-insulated section 4*b*, respectively.

As will be understood from the comparison between FIG. 14 and FIG. 3A, the fourth embodiment can be distinguished from the first embodiment only by the construction of the evaporating section 4*a* and the working medium used. Namely, other portions of these embodiments are materially identical. Namely, in the fourth embodiment of the invention one-component working medium is used rather than the two-component working medium as in the first embodiment. Further, in the fourth embodiment, the partition pipe 14 is provided in the closed vessel 4 at the position close to the inner peripheral surface of the latter, and the down-comer pipe 13*a* similar to that in the first embodiment is disposed at the center of the vessel 4. The lower end of the partition pipe 14 is connected to the lower end of the down-comer pipe 13*a* through an annular partition plate 13 which faces the inner surface of the bottom wall of the vessel 4. Consequently, a reservoir chamber 21A for storing the working medium liquid is formed between the inner surface of the bottom wall of the vessel 4 and the partition plate 13. This reservoir chamber is communicated with the down-comer pipe 13*a* and also with the limited space or pumping space 23A defined between the inner peripheral surface of the vessel 4 and the partition pipe 14. The fourth embodiment employs only the low-boiling-point medium as the working medium. The operation of this fourth embodiment is as follows.

As the evaporating section 4*a* in the lower portion of the vessel 4 is heated by heat A derived from a medium or low-temperature heat source flowing through the duct connected to the vessel 4 through the evaporating section mounting joint 4*d*, the heat is delivered to the inside through the evaporating section 4*a* so that the low-boiling-point medium liquid A in the limited space 23A defined by the upward flow partition pipe 14 is heated. Consequently, boiling and evaporation occur at sites in the recesses formed in the inner surface to allow the growth of the vapor bubbles 12*a* of the working medium. The two-phase working medium consisting of liquid phase and vapor phase then flows upwardly through the limited space 23A as indicated by an arrow E due to the pumping action created by the rising vapor bubbles. Thereafter, a gas-liquid separation is made on the liquid surface within the limited space 23A, so that the vapor 12*b* flows upwardly while the unevaporated working medium liquid 12 is gradually boiled and evaporated by the heat supplied from the outside. In the meantime, the working medium liquid 12 of an amount corresponding to the amount of the liquid 12 lost by the evaporation is supplied into the reservoir chamber 21A through the down-comer pipe 13*a*. Meanwhile, the working medium 12 displaced and scattered by the voids 12*a* is collected in the space between the down-comer pipe 13*a* and the upward flow partition pipe 14 and is gradually heated to be boiled at its surface.

On the other hand, the vapor 12*b* of the working medium thus produced is made to flow upwardly through the heat-insulated section 4*b* covered by a heat-insulating material and then through the upward vapor flow passage 16*a* into the high-pressure vessel 16 so as to be temporarily stored in the latter. The vapor is then introduced into the turbine 7 through the turbine inlet pipe 16*c* and makes an adiabatic expansion across the turbine to drive the latter. The turbine 7 in turn drives the generator 18 through the shaft 8 thereby to produce the electric power. The turbine 7 is preferably a radial in-flow type turbine which offers a higher efficiency than the axial flow turbines. The vapor 12*b* of the working medium 12*b* after the adiabatic expansion is introduced through the turbine outlet pipe 16*d* into the low-pressure chamber 17 for the working medium vapor and is stored temporarily in the latter. The vapor 12*b* is then injected as vapor bubbles 12*a* into the working medium liquid 12 by the working medium vapor injector 17*a*. In consequence, the vapor 12*b* of the working medium is condensed through direct contact with the working medium liquid which has the same composition as the vapor and which has been condensed as a result of the heat radiation from the condensing section 4*c*.

Consequently, the working medium liquid 12 is returned to the reservoir chamber 21A through the down-comer pipe 13*a* by the force produced by the difference in the head of the working medium liquid 12 and the saturation condensation pressure. The medium is then boiled in the reservoir chamber 23A to repeat the operation cycle explained hereinbefore.

Figure 15A:
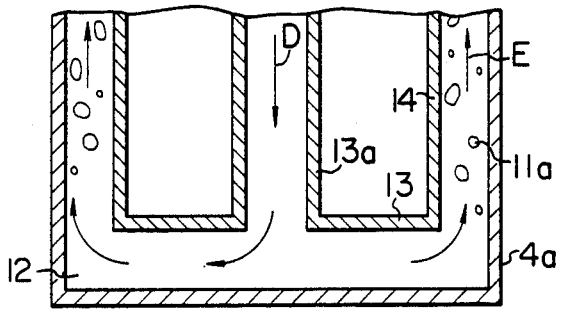
FIG. 15A is a sectional view showing the path of flow of the working medium in the fourth embodiment.
Figure 15B:
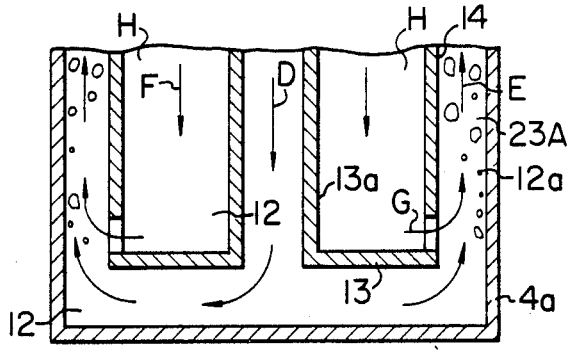
FIG. 15B is a sectional view of a modification of the arrangement as shown in FIG. 15A.

In the fourth embodiment described hereinbefore, the evaporating section 4*a* of the vessel 4 has such an internal structure that the working medium liquid flows through passages which are perfectly partitioned by the down-comer pipe 13*a*, partition plate 13 and the upward-flow partition pipe 14, as shown in FIG. 15A. This arrangement, however, is not exclusive and may be substituted by another arrangement shown in FIG. 15B. Namely, in the arrangement shown in FIG. 15B, a port is formed in a lower portion of the upward-flow partition pipe 14, so that the working fluid 12, which has been introduced into the space H between the partition pipe 14 and the down-comer pipe 13 as indicated by arrow F, is circulated to the space 23A through the port as indicated by arrow G. Whether the construction shown in FIG. 15A or the construction shown in FIG. 15B should be taken is determined accounting for the following condition. Namely, the amount of the working medium liquid 12 jumping from the boiled medium liquid surface is ruled by the pressure balance presented by the saturated vapor pressure of the working medium in the evaporating section 4*a* and the saturated condensation pressure of the same in the condensing section and the difference in the head of the liquid in both sections, i.e. the state of balance between the heat applied to the evaporating section 4*a* and the heat radiated from the condensing section. Thus, the arrangement shown in FIG. 15A is preferably adopted when the amount of working medium liquid flowing into the space H is small, while the arrangement shown in FIG. 15B is preferably employed when the amount of the working medium liquid 12 introduced into the space 12 is large.

Figure 16A:
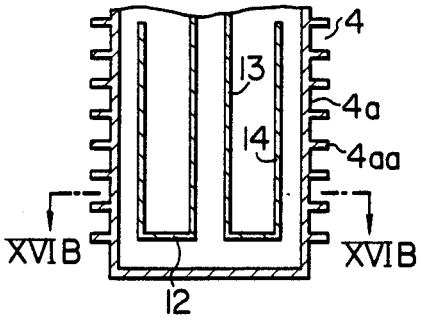
FIG. 16A is a vertical sectional view showing the internal construction of the evaporating section in the fourth embodiment.
Figure 16B:
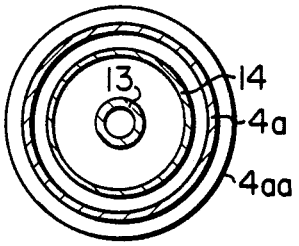
FIG. 16B is a sectional view of the evaporating section of FIG. 16A taken along the line XVIB—XVIB.
Figure 16C:
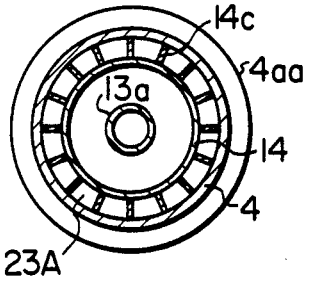
FIGS. 16C and 16D are illustrations similar to that in FIG. 16B, showing a void-merging prevention means adoptable in the fourth embodiment.
Figure 16D:
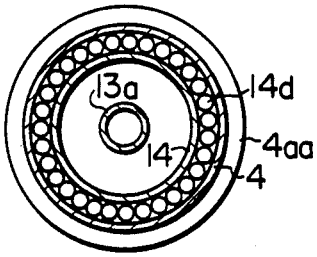

The void pumping action produces a natural circulating flow of the two-phase medium consisting of the working medium liquid 12 and the bubbles or voids 12*a*, which moves upwardly through the limited space 23A defined between the upward flow partition pipe 14 and the inner peripheral surface of the evaporating section 4*a* of the vessel 4. In order to present joining of the voids 12*a* of the vapor thereby to obtain a stable pumping action by the voids, it is preferred to use a partition plate 14*c* as shown in FIG. 16C or a partition pipe 14*d* as shown in FIG. 16D. More speciically, in the arrangement shown in FIG. 16C, the limited space 23A is divided in the circumferential direction into a plurality of sections by means of a plurality of partition plates 14*c* which extends radially to connect the partition pipe 14 and the peripheral wall of the vessel 4 to each other and vertically through the limited space 23A. On the other hand, in the arrangement shown in FIG. 16D, a multiplicity of partition tubes 14*d* are disposed in the limited space 23A in a side-by-side fashion in the circumferential direction so that the voids of the vapor of the working medium are generated in respective partition tubes 14*d*.

Figure 17:
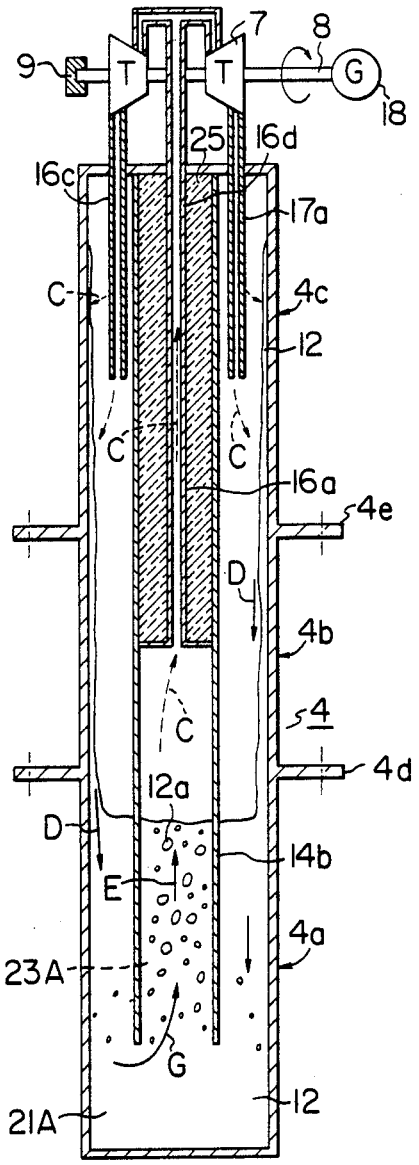
FIG. 17 is a vertical sectional view of a fifth embodiment of the thermo-siphon type generator of the invention.

A fifth embodiment of the invention will be described hereinunder with specific reference to FIG. 17. This embodiment differs from the embodiment shown in FIG. 14 in the following points. Namely, in this embodiment, the evaporating section is constructed such that the upward flow takes place at the radially inner side while the downward flow occurs at the radially outer side. In addition, the high pressure vessel and the low pressure vessel in the condensing section 4*c* are omitted. Furthermore, the vapor 12*b* of the working medium coming out of the turbine outlet pipes 16*d* is made to contact with the wall of the condensing section 4*c* of the vessel 4 to promote the condensation. In this fifth embodiment, therefore, the internal structure of the vessel 4 is very much simplified.

More specifically, in this fifth embodiment of the invention, the vessel 4 accomodates a partition pipe 14*b* which extends vertically substantially along the axis of the vessel 4 from the top wall down to a position near the bottom end of the vessel 4. The portion of the space in the vessel 4 below the lower end of the partition pipe 14*b* serves as a reservoir chamber 21A for the working medium liquid 12, while the space inside the portion of the partition pipe 14*b* within the evaporating section serves as the limited space or pumping space 23A which causes the void pumping action. A vapor introduction pipe or passage 16C disposed in the partition pipe 14*b* extends from the heat-insulated section 4*b* through the condensing section 4*c* up to the inlet of the turbine 7 which is disposed above the top wall of the vessel 4, so that the vapor of the working medium produced in the space 23A is introduced to the turbine 7 through the pasage 16C as indicated by arrow C. The turbine outlet pipes 16*d* lead from the vapor outlets of the turbines 7 into the condensing section 4*c* in the vessel 4*c* through the top wall of the vessel 4. The portions of the turbine outlet pipes 16*d* received by the vessel 4 are positioned between the partition pipe 14*b* and the inner peripheral surface of the vessel 4 defining the condensing section 4. A multiplicity of injection holes 17*a* for injecting the vapor towards the inner peripheral surface of the vessel 4 are formed in the wall of the turbine outlet pipes 16*d*. Therefore, the injected vapor is condensed and returned to the reservoir chamber 21A as indicated by arrow D.

Figure 18:
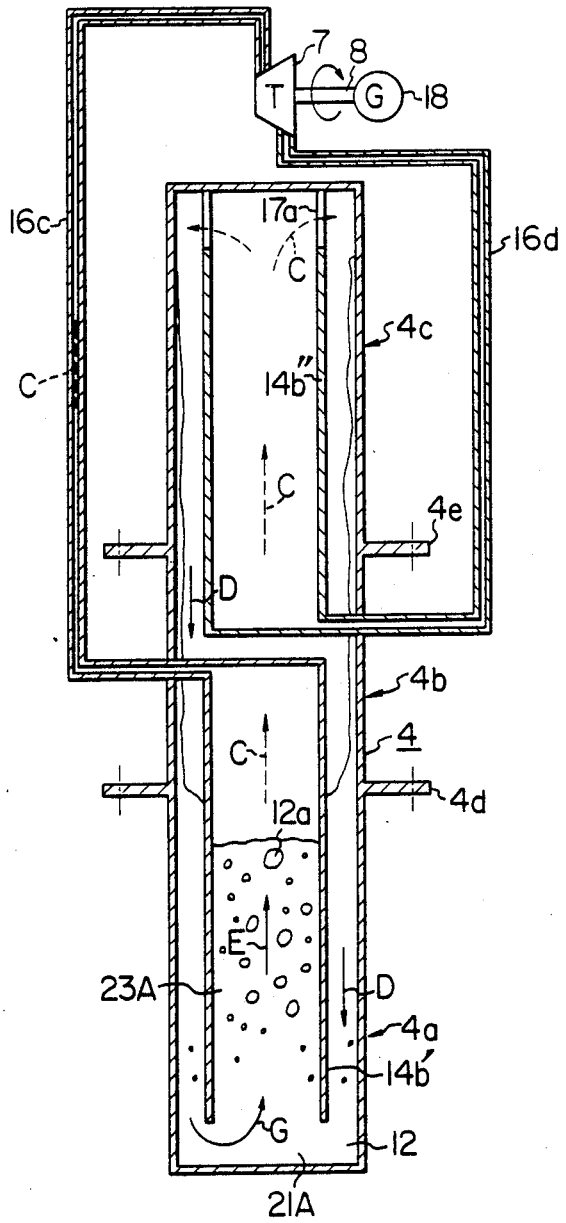
FIG. 18 is a vertical sectional view of a sixth embodiment of the thermo-siphon type generator of the invention.

FIG. 18 shows a sixth embodiment of the invention. In this embodiment, a partition pipe 14*b*′ extends substantially along the axis of the vessel 4 from a position near the bottom wall of the evaporating section 4*a* to the substantially heightwise mid portion of the heat-insulated section 4*b*. Another partition pipe 14*b*″ is disposed to extend substantially coaxially with the partition pipe 14*b*′ from a position adjacent to the upper end of the partition pipe 14*b*′ in the heat-insulated section 4*b* to the top wall of the vessel 4. The portion of the space in the vessel 4 below the lower end of the partition pipe 14*b*′ serves as the reservoir chamber 21A for the working medium liquid 12. The space inside the partition pipe 14*b*′ within the evaporating section 4*a* constiutes the limited space or pumping space 23A which causes the void pumping action. The upper portion of the partition pipe 14*b*′ disposed within the heat-insulated portion 4*b* is connected to the turbine inlet pipe 16*c* which extends outside the vessel 4 to the vapor inlet of the turbine 7 which is disposed above the vessel 4. The lower end of the upper partition pipe 14*b*″ within the heat-insulated section 4*b* and the vapor outlet of the turbine 7 are connected to each other through a turbine outlet pipe 16d which extends externally of the vessel 4. The portion of the wall of the partition pipe 14b'' near the upper end of the latter is provided with injection ports 17a through which the vapor of the medium, which has been introduced into the partition pipe 14b'' through the turbine outlet 16d, is injected towards the inner peripheral surface of the vessel 4 defining the condensing section 4c. Therefore, the vapor generated in the space 23A is introduced to the turbine 7 through the turbine inlet pipe 16c, while the vapor after expansion through the turbine 7 is introduced through the turbine outlet pipe 16d into the partition pipe 14b'' and is jetted from the latter into the inner peripheral surface of the vessel 4 through the injection holes 17a. The injected vapor of the working medium is condensed and returned to the reservoir chamber 21A. According to this arrangement, it is possible to suppress the undesirable condensation of the vapor in the turbine inlet pipe 16c due to indirect heat exchange with the ambient liquid phase of the working medium. In addition, the internal structure of the condensing section is simplified advantageously.

Figure 19:
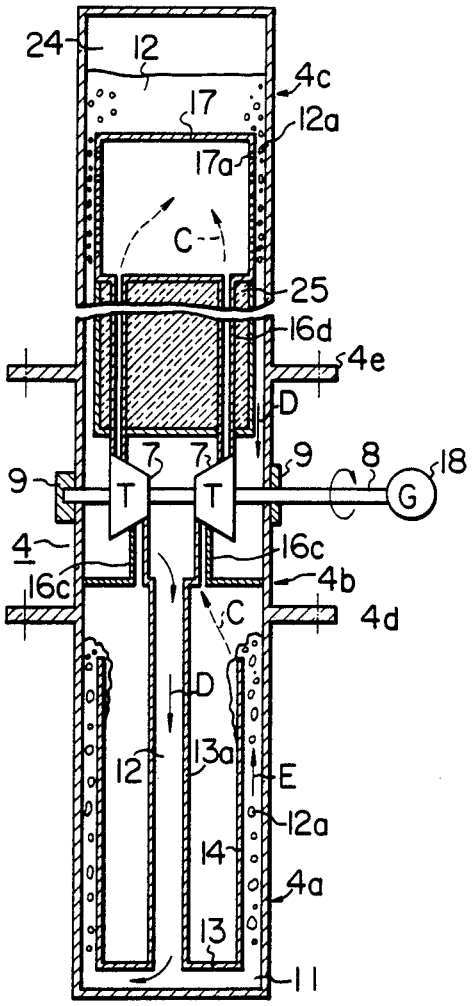
FIG. 19 is a vertical sectional view of a seventh embodiment of the thermo-siphon type generator of the invention.

FIG. 19 shows a seventh embodiment of the invention. In this embodiment, the turbine 7 is disposed in the heat-insulated section 4b of the vessel 4 and the shaft 8 thereof is supported by the wall of the vessel 4 through bearings 9.

In this seventh embodiment, the high-pressure vessel for the working medium vapor used in the fourth embodiment shown in FIG. 14 is omitted so that the vapor of the working medium is introduced from the heat-insulated section 4b into the turbine 7 through a turbine inlet pipe 16c which is disposed in the vessel 4. The vapor of the working medium after expansion through the turbine 7 is discharged into the low-pressure vessel 17 for the working medium vapor through the turbine outlet pipe 16d which is also provided in the vessel 4. The space around the turbine outlet pipe 16d is filled with a heat-insulating material. Other portions of this seventh embodiment is materially identical to those of the fourth embodiment. In this seventh embodiment, all of the turbine 7, turbine inlet pipe or passage 16c and the turbine outlet pipe 16d are disposed within the vessel 4, so that the construction is made more compact advantageously. On the other hand, however, a troublesome work is required for mounting the turbine 7 in the vessel 4.

Figure 20:
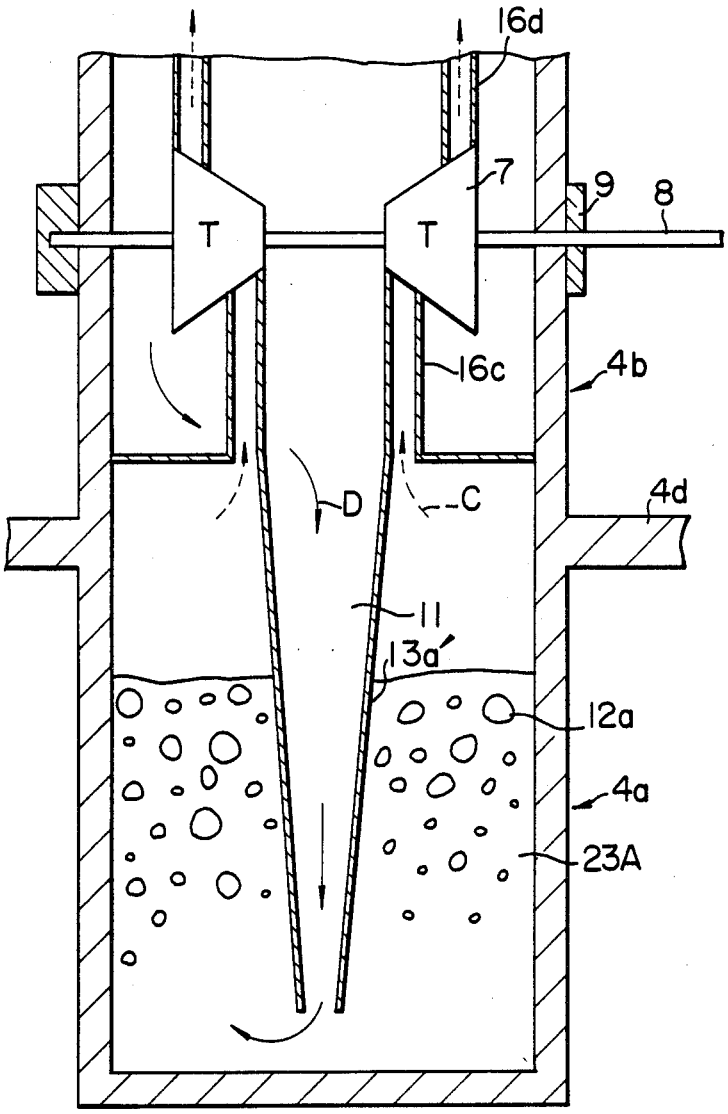
FIG. 20 is a vertical sectional view of a modification of the seventh embodiment.

FIG. 20 shows a modification of the seventh embodiment shown in FIG. 19. This modification employs, in place of the straight down-comer pipe 13a used in the seventh embodiment, a tapered down-comer pipe 13a' the cross-sectional area of which is gradually decreased along the length thereof towards the lower end from a portion within the heat-insulated portion. The use of this tapered down-comer pipe offers the following advantage. Namely, the velocity of the downward flow of the working medium liquid in the down-comer tube is increased, so that the liquid of the working medium is introduced into the limited space or the pump space 23A at an increased velocity. Consequently, the initial velocity of the working medium in the limited space can be increased to elevate the flow velocity of the working medium vapor, thereby to enhance the efficiency of supply of the vapor into the turbine inlet pipe 16c. In addition, the jetting of the working medium liquid from the lower end of the down-comer pipe produces a kind of stirring effect. In the modification shown in FIG. 20, the partition pipe 14 and the partition plate 13 in the seventh embodiment are omitted, and the limited space 23A is formed between the portion of the wall of the vessel 4 defining the evaporating section 4a and the down-comer pipe 13a'.

Figure 21:
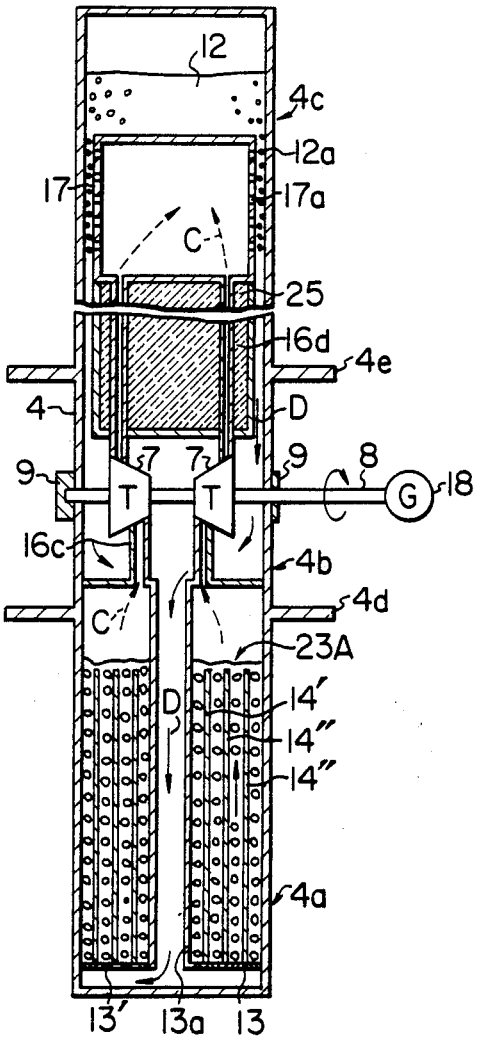
FIG. 21 is a vertical sectional view of an eighth embodiment of the thermal-siphon type generator of the invention.

FIG. 21 shows an eighth embodiment of the invention. This eighth embodiment has an internal structure of the evaporating section 4a which is slightly changed from that of the seventh embodiment shown in FIG. 19.

Namely, in this eighth embodiment, the outer periphery of the partition plate 13 in the seventh embodiment is extended so as to be connected to the inner peripheral surface of the vessel 4, and the space defined by the inner peripheral surface of the vessel 4 and the down-comer tube 13a is utilized as the limited space 23A. A plurality of partition pipes 14', 14'', 14''' are disposed in this limited space 23A substantially concentrically with the down-comer pipe 13a to divide the space 23A into a plurality of annular sub-spaces. The partition plate 13 used in the eighth embodiment employs a multiplicity of injection ports 13' for injecting the working medium liquid into each annular chamber. By employing the multi-tube structure as in the eighth embodiment, it is possible to increase the void ratio in the upward two-phase flow of the medium to increase the rate of evaporation of the working medium liquid. In the eighth embodiment of the invention, the amount of the working medium confined in the vessel 4 is increased considerably to require greater heat input and output correspondingly.

Obviously, the vessel 4 of the fourth to eighth embodiments can employ various modifying structures such as the high-fin pipe 4ab as shown in FIG. 12A, disc fin 4ac as shown in FIG. 12B, fins 4f having keen edges as shown in FIG. 13A, and the pipe with inner peripheral grooves as shown in FIG. 13B.

As has been described, the present invention provides a thermo-siphon type generator apparatus having a simple construction and operable merely by an external heating which causes a semi-permanent natural recirculation of working medium due to the void pumping effect and the effect of the force of gravity. According to the invention, therefore, it is possible to obtain a compact thermo-siphon type power generating apparatus which can be used suitably in small and medium-scale power generating plant.

Although the invention has been described through specific terms, it is to be understood that the described embodiments and modifications are only illustrative and various changes and modifications may be imparted thereto without departing from the scope of the invention which is limited solely by the appended claims.

What is claimed is:

1. A thermo-siphon type generator apparatus comprising:

a vessel filled with a working medium containing a heat medium and a low boiling-point medium which are insoluble to each other, said vessel defining a lower evaporating section, an upper condensing section and a heat-insulated section between said evaporating and condensing sections;

a turbine connected to a generator;

a first passage means for introducing the vapor of said low-boiling-point medium generated in said evaporating section to said turbine;

a second passage means for introducing the vapor from said turbine to said condensing section;

said evaporating section including a space in which said heat medium flows downwardly, a vapor bubble pumping space and a third passage means in which the low-boiling-point medium liquid flows downwardly, said pumping space and said space in which the heat medium flows downwardly being communicated with each other at their upper ends and their lower ends, and said space in which said low-boiling point medium liquid flows downwardly being communicated with the lower end of the pumping space, said pumping space being adapted to generate, when heated, upward movement of vapor bubbles of said low-boiling-point medium thereby to forward the vapor of said medium to said turbine through said first passage means.

2. A thermo-siphon type power generator apparatus according to claim 1, wherein said third passage means including a down-comer pipe which extends in said closed vessel from said heat-insulated section down to a reservoir chamber, said apparatus further comprising: a partition means which divides the space in said evaporating section above said reservoir chamber and surrounding said down-comer pipe into a radially inner space constituting said space in which said heat medium flows downwardly and a radially outer space filled with the liquid of said heat medium, said radially outer space constituting said vapor bubble pumping space; and an injection means provided on the partition wall separating said reservoir chamber from said radially inner and outer spaces and adapted to inject the liquid of said low-boiling-point medium from said reservoir chamber into said pumping space.

3. A thermo-siphon power generator apparatus according to claim 2, characterized by further comprising a partition wall disposed in said vessel so as to provide a gap between the inner peripheral surface of said closed vessel and the space constituted by said pumping space and said reservoir chamber, said gap being filled with said heat medium liquid.

4. A thermo-siphon type power generator apparatus according to claim 1, characterized by further comprising a partition means disposed in said pumping space for dividing said pumping space into a plurality of small sections which are arranged in a side-by-side fashion in the circumferential direction of said closed vessel.

5. A thermo-siphon type power generator apparatus according to claim 1, wherein at least one of the walls defining said pump space is provided with a multiplicity of recesses each having a restricted opening and an ample inside space.

6. A thermo-siphon type power generator apparatus according to claim 1, wherein at least one of the walls defining said pumping space is formed of a porous material.

7. A thermo-siphon type power generator apparatus according to claim 1, wherein said turbine and said generator are disposed above and outside said closed vessel.

8. A thermo-siphon type power generator apparatus according to claim 1, wherein said turbine is accomodated by said heat-insulated section of said closed vessel.

9. A thermo-siphon type power generator apparatus according to any one of claims 1 to 8, wherein said condensing section includes a vapor chamber connected to said second pasage means, and a condensate chamber formed around said vapor chamber and connected to said reservoir chamber, said vapor chamber and said condensate chamber being separated from each other by a partition wall provided with a vapor injecting means.

10. A thermo-siphon power generator apparatus according to claim 7, wherein said first passage means includes a passage extending through said closed vessel from said heat-insulated section to the turbine inlet, while said second passage means includes a passage leading from the turbine outlet to said condensing section through said vessel.

11. A thermo-siphon type power generator apparatus according to claim 7, wherein said first passage means includes a passage extending externally of said closed vessel between said heat-insulated section and the turbine inlet, while said second passage means includes a passage which extends externally of said closed vessel from the turbine outlet into said heat-insulated section in said closed vessel and then into said condensing section.

* * * * *